US005302793A

United States Patent [19]

Eke

[11] Patent Number: 5,302,793

[45] Date of Patent: Apr. 12, 1994

[54] MICROWAVE OVENS WITH AIR INLET AND AIR OUTLET TEMPERATURE SENSORS

[75] Inventor: Kenneth I. Eke, Woldingham, United Kingdom

[73] Assignee: Microwave Ovens Limited, Shirley, United Kingdom

[21] Appl. No.: 53,950

[22] Filed: Apr. 27, 1993

[30] Foreign Application Priority Data

Apr. 30, 1992 [GB] United Kingdom ..... 9209350

[51] Int. Cl.[5] ..... H05B 6/68

[52] U.S. Cl. ..... 219/710; 219/719; 219/757; 99/325

[58] Field of Search ..... 219/10.55 B, 10.55 R, 219/10.55 E, 10.55 M, 400; 99/325, 451

[56] References Cited

U.S. PATENT DOCUMENTS 4,131,779 12/1978 Tatsukawa et al. ..... 219/10.55 R
4,520,251 5/1985 Yokozeki ..... 219/10.55 M
4,647,746 3/1987 Eke ..... 219/10.55 B
4,661,670 4/1987 Eke ..... 219/10.55 B
4,794,219 12/1988 Eke ..... 219/10.55 M

*Primary Examiner*—Philip H. Leung
*Attorney, Agent, or Firm*—Lee, Mann, Smith, McWilliams, Sweeney & Ohlson

[57] ABSTRACT

A microwave oven has a magnetron 26 cooled by a fan 30 which generates a flow of air which is admitted to the oven cavity 10 through an inlet aperture 32, leaving the cavity through an outlet aperture 36. A grill element 22 is located in the upper part of the cavity 10 and a turntable 24 is positioned in the lower part of the cavity 10. Where the air respectively enters and leaves the cavity, thermocouples monitor air inlet (Ti) and air outlet (To) temperatures. After cooking commences, the air inlet and air outlet temperatures are monitored. After a time dependent on the load of the food item being cooked, the plot of air outlet temperature against time crosses the plot of air inlet temperature against time. The crossover point 44 of the air inlet and air outlet temperatures is used to control the remaining cooking time and the duration of energisation of the magnetron and the grill element during the remaining cooking time.

10 Claims, 3 Drawing Sheets

MICROWAVE OVENS WITH AIR INLET AND AIR OUTLET TEMPERATURE SENSORS

FIELD OF THE INVENTION

This invention relates to microwave ovens and to methods of cooking food.

BACKGROUND TO THE INVENTION

Microwave ovens having radiant heating elements are known. Foodstuffs of different size, shape and dielectric loads produce different air temperature characteristics within the oven. The invention aims to provide a way of making the operation of such ovens automatic by monitoring air temperatures in the oven and using the monitored air temperatures to govern the operation of a microprocessor which controls cooking time and energisation of the magnetron and the radiant heating elements.

DISCLOSURE OF THE INVENTION

According to one aspect of the invention there is provided a method of cooking food in a microwave oven comprising an oven cavity to receive the food, a magnetron for delivering microwave power to the oven cavity, means for admitting to the cavity a flow of air which cools the magnetron, and a radiant heating element for delivering radiant power to the oven cavity, wherein the temperature of the air cooling the magnetron is detected as the air enters the cavity to yield an air inlet temperature and the temperature is detected as the air leaves the cavity to yield an air outlet temperature, monitoring the air inlet and air outlet temperatures, detecting the crossover point of the air inlet and air outlet temperatures and utilising the magnitude of the crossover temperature or time to influence the duration of the remaining cooking time and the application of microwave power and radiant power during the remaining cooking time.

When a cooking operation commences from cold, the air inlet temperature and the air outlet temperature will both be at ambient temperature level. When cooking commences with the simultaneous application of microwave power and radiant heat, the air inlet temperature rises more rapidly than the air outlet temperature. The temperature of the inlet air is representative of the dielectric load of the foodstuff placed in the oven because the greater the dielectric load of the food item the more microwave energy is absorbed by the load and hence the cooler will the magnetron run, hence lowering the temperature of the inlet air. The air outlet temperature is influenced by the air inlet temperature, the dielectric load and the thermal mass of the food item.

As cooking progresses, the air outlet temperature begins to rise more rapidly and there will be a point at which the plot of air outlet temperature against time crosses the plot of the air inlet temperature against time. This is the crossover point which is relied upon in the present invention to determine the thermal load and microwave load of the food item, so that the subsequent cooking process can be controlled, both in terms of duration and application of microwave power and radiant power, during the remaining cooking time.

The complete cooking process preferably comprises three stages, namely a first stage from commencement of cooking to said crossover point, a second stage from the crossover point to the time when the difference between the inlet and outlet temperatures reaches a predetermined value and a third stage from the termination of the second stage to the end of cooking, the microprocessor controlling the duration of the third stage and the energisation of the magnetron and the radiant heating element throughout cooking.

According to another aspect of the invention a microwave oven comprises an oven cavity to receive food to be cooked, a magnetron for delivering microwave power to the oven cavity, means for admitting to the cavity a flow of air which cools the magnetron, a radiant heating element for delivering radiant power to the oven cavity, a timer for timing cooking, a first temperature sensor for sensing the temperature of the air flow as it enters the cavity, a second temperature sensor for sensing the temperature of the air flow as it leaves the cavity, and a microprocessor responsive to the timer and the first and second temperature sensors for controlling the magnetron and the radiant heating element, wherein the microprocessor is operative to detect the crossover point of the air inlet and air outlet temperatures and, in dependence on the magnitude of the crossover temperature or time, to influence the duration of the remaining cooking time and the application of microwave power and radiant power during the remaining cooking time.

The first temperature sensor is preferably arranged in an inlet aperture in one side wall of the cavity, and the second temperature sensor is arranged in an outlet aperture in the other side wall of the cavity. Preferably the outlet aperture is positioned nearer the bottom of the cavity than the top thereof, and in a preferred embodiment of the invention, the outlet aperture is at substantially the same level as the turntable, conveniently at the point in the other side wall where the rim of the turntable is closest to the other side wall.

Preferably the radiant heating element is a grill element in the top of the cavity.

The invention will now be further described by way of example with reference to the accompanying drawings, in which.

Figure 1:
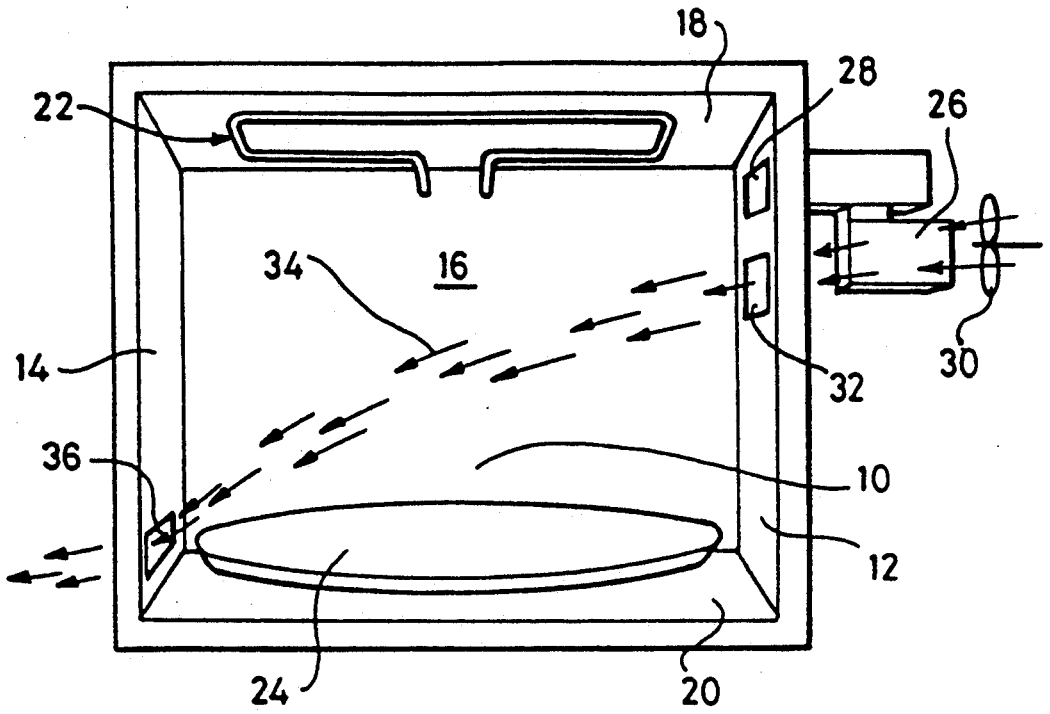
FIG. 1 is a diagrammatic front view of a microwave oven according to the invention.

Referring to FIG. 1, the oven has a cavity 10 defined by two side walls 12 and 14, a back wall 16, a top wall 18, a base 20 and an openable front door (not shown). A radiant grill element 22 is positioned just below the top wall 18 and the base 20 supports a rotatable turntable 24 for supporting a food item to be cooked in the oven.

In addition to the radiant heating element provided by the grill element 22, the oven has a magnetron 26 which delivers microwave power to the oven cavity 10 through an aperture 28. The magnetron 26 is cooled by a cooling fan 30, the flow of air from which enters the cavity 10 through an air inlet aperture 32 in the side wall 12. The air flow, generally indicated at 34, passes through the cavity 10 and leaves the latter by means of an air outlet aperture 36 formed in the side wall 14. It can be seen that the outlet aperture 36 is positioned near the bottom of the cavity and is at substantially the same level as the turntable 24. The outlet aperture 36 is positioned in the side wall 14 approximately midway between the front and rear edges thereof, so as to be in that area of the side wall 14 which is closest to the rim of the turntable 24.

The temperature of the air flow 34 is sensed at two positions: by means of a first thermocouple positioned in the inlet aperture 32 and by a second thermocouple located in the outlet aperture 36. The first thermocouple detects air inlet temperature (Ti) and the second thermocouple detects air outlet temperature (To). The electrical signals from the two thermocouples are, together with a timer, linked to a microprocessor which controls the operation of the oven.

Figure 2:
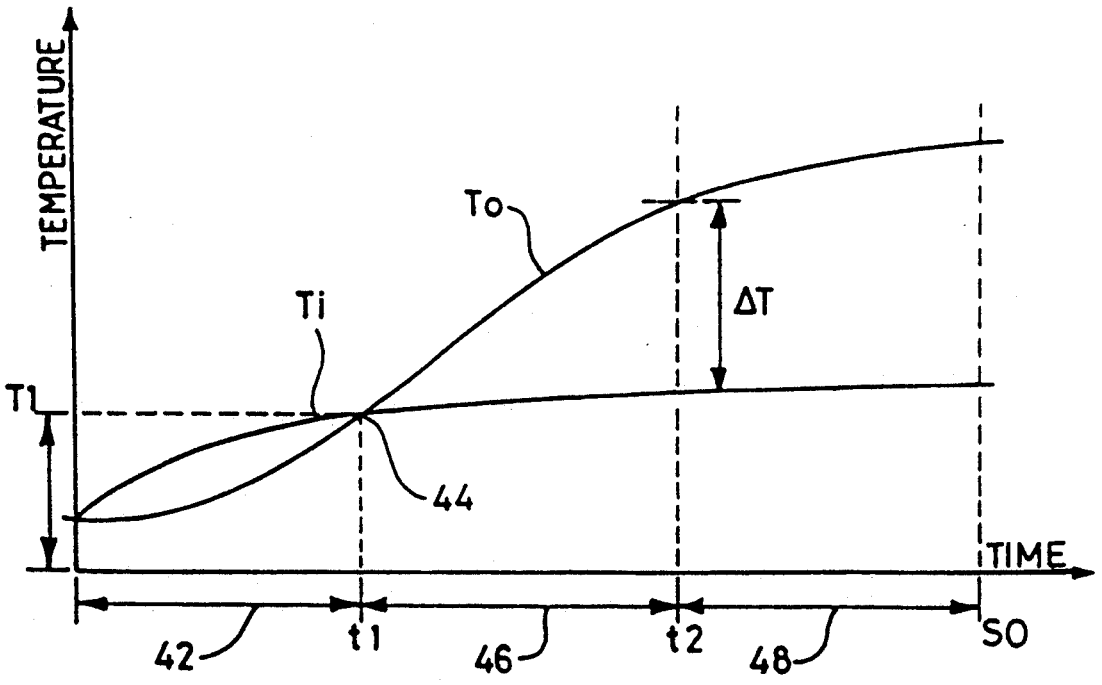
FIG. 2 is a graph showing plots of air inlet and air outlet temperatures against time.

FIG. 2 shows how Ti and To vary with time in a typical cooking operation. Ti and To start from the same temperature, normally ambient temperature. Microwave power and radiant power are applied simultaneously to the cavity, as a result of which Ti and To both increase, but initially Ti increases more steeply so that during a first stage of cooking 42 the plot of Ti lies above the plot of To. The characteristics of both Ti and To will vary in dependence upon the thermal and microwave load of the food item being cooked so the shapes of the plots of Ti and To during the first stage 42 will be representative of the type of food item being cooked.

As cooking progresses, the outlet temperature To, after its more gradual beginning, begins to increase more steeply than the inlet temperature Ti and there will thus be a crossover (indicated at 44) at which the plots of Ti and To cross. In FIG. 2, the crossover point occurs at time t1 at a temperature T1, and the crossover point 44 defines the end of the first stage 42. The magnitude of t1 and/or T1 is sensed by the microprocessor and, in dependence on the value of t1 and/or T1, the microprocessor selects a difference temperature ΔT, typically beteween 20° C. and 40° C. Preferably, the microprocessor derives ΔT by referring to a stored characteristic relating values of t1 to values of ΔT. The first stage 42 can be regarded as compensating for differing ambient temperatures and differing starting temperatures in the cavity.

Cooking proceeds through the second stage 46, with the simultaneous and continuous application of microwave power and radiant power and during this second stage the difference between To and Ti is monitored, until this difference reaches the preselected value ΔT, which marks the end of the second stage 46. Hence, after the cross over point 44, Ti and To continue to be monitored and when the difference between Ti and To reaches ΔT the microprocessor signals the end of the second cooking stage 46 at time t2.

At the end of the second cooking stage 46 at time t2, the microprocessor determines the time of a third stage 48 (and hence the time to switch off SO) and also the heating routine, i.e. the extent and duration of energisation of both the magnetron and the grill element. This is achieved by the microprocessor referring to the stored characteristic of FIG. 3, which relates values of the duration of the second stage 46 (i.e. t2–t1) to values of total cooking time S0. Hence at time t2, the microprocessor computes the duration of the third stage 48, (S0–t2) and the oven displays a remaining cooking time, counting down to zero at switch off at S0.

During the third stage 48, microwave power is preferably applied continuously but may be pulsed, if desired. Energisation of the grill element 22 during the third stage 48 is governed by the microprocessor in accordance with the stored characteristic of FIG. 4 which relates the percentage of the time of the third stage 48 during which the grill element 22 is energised to total cooking time S0. Hence, at time t2 the microprocessor, having determined the total cooking time S0 from the characteristic of FIG. 3, determines the percentage of time of the third stage during which the grill element 22 is energised. Energisation of the grill element is intermittent (i.e. pulsed), there typically being between about three and six pulses or periods of energisation of the grill element 22 during the third stage 48, resulting in the aggregate period of energisation, as a proportion of the total duration of the third stage, corresponding to the percentage derived from the characteristic of FIG. 4.

It is thought that the invention will have particular application to the cooking of poultry which has a particular cooking requirement in terms of the amount of microwave energy and the amount of radiant energy. This balance can be predetermined and programmed into the microprocessor so that once the thermal mass of the poultry item is determined the heating routine is selected and the cooking time to switch off calculated by the microprocessor. For example, for large poultry items (e.g. whole chickens), t1 will be comparatively long, ΔT will be comparatively large, the duration of the third stage 48 will be comparatively long and the proportion of the third stage 48 during which the grill element is energised will be comparatively small, to prevent the grill element 22 burning the chicken. For a small chicken item (e.g. a small chicken piece) the converse will apply, the grill element 22 being energised for a greater proportion of the third stage because of the smaller risk of burning.

The turntable 24 may be provided with what is termed a "crisp plate" this is an aluminium circular dish which is placed on the turntable and which is heated from below by a microwave absorbent coating. When the dish carries a large food load it heats up more slowly than when it only has a small load. The second thermocouple, being situated adjacent to the rim of the crisp plate, is able to detect temperature changes in the crisp plate. This provides an opportunity to control the cooking of essentially flat food items which have high and consistent contact with the crisp plate, such as pizzas.

Figure 5:
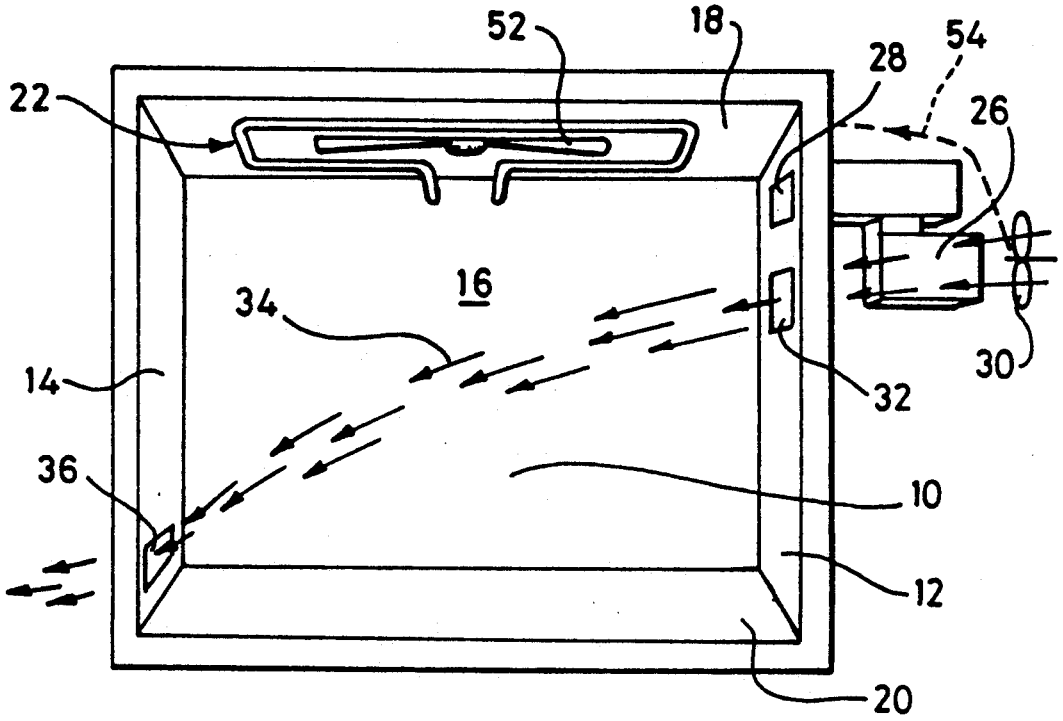
FIG. 5 shows a modification of the oven of FIG. 1.
Figure 6:
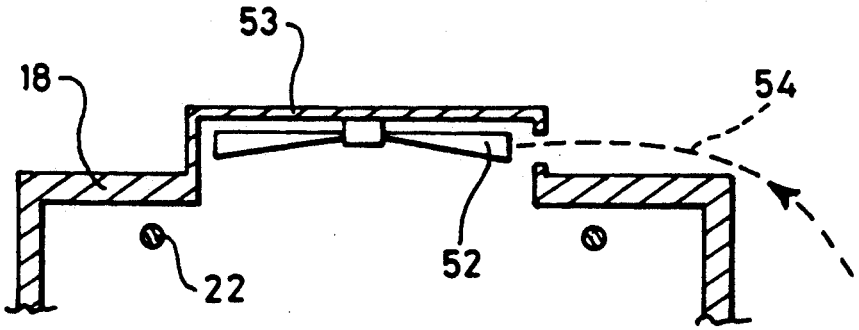
FIG. 6 is a fragmentary view illustrating part of the oven of FIG. 5.

The oven shown in FIGS. 5 and 6 (in which parts corresponding to those of FIG. 1 bear the same reference numerals) has no turntable, the food being supported on a stationary shelf (not shown) in the oven cavity 10. In the absence of the turntable it is necessary to include a mode stirrer, and in the oven of FIGS. 5 and 6 this is in the form of a bladed mode stirrer 52 rotatably mounted about a substantially vertical axis. The mode stirrer 52 is located in a rectangular box-like extension 53 (FIG. 6) projecting above the top wall 18. The mode stirrer 52 is rotatably driven by a stream of air 54. This stream is derived from the output of the fan 30 and is not heated by the magnetron.

Figure 3:
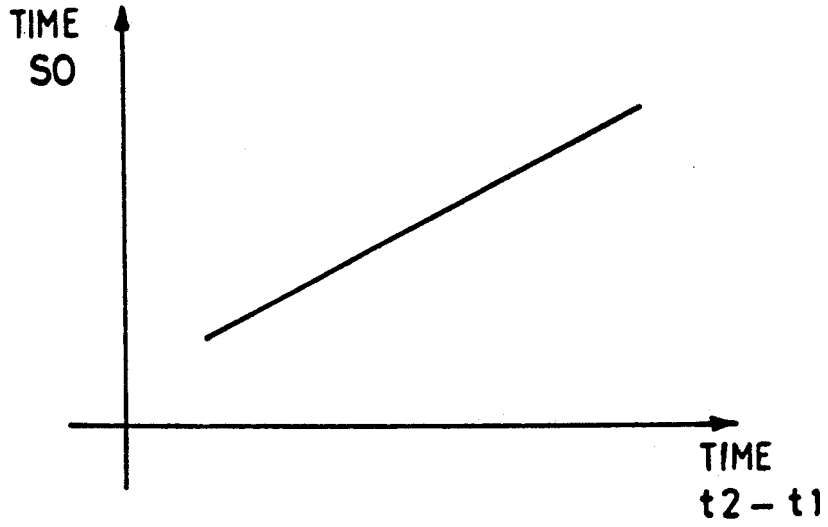
FIGS. 3 and 4 show graphs of two characteristics stored in a microprocessor of the oven.
Figure 4:
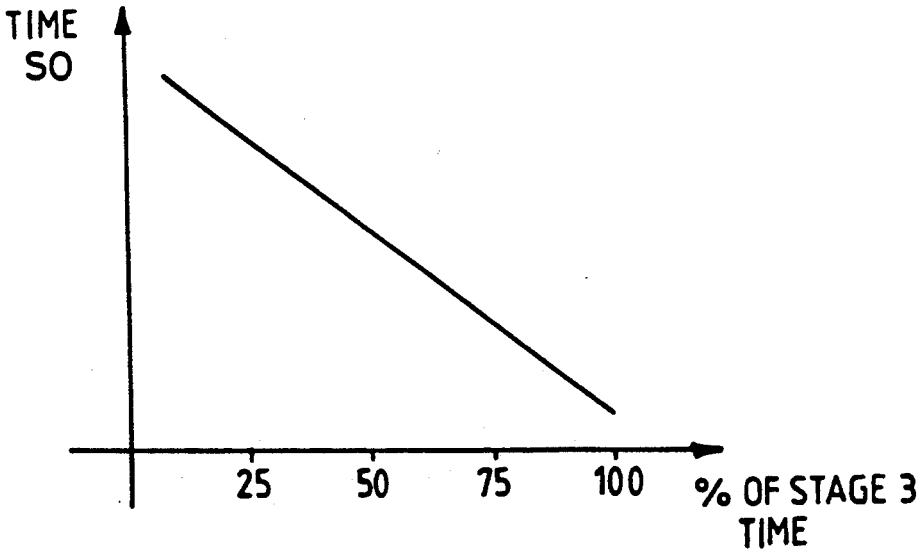

The ovens of FIGS. 1, 5 and 6 operate in accordance with the preceding description given with reference to FIGS. 2 to 4. However, it is possible to modify the inventive oven to follow a cooking process having two stages only. The first stage corresponds to the stage 42 previously described. At the crossover time t1, the microprocessor records the duration of the first stage (i.e. t1) and, from the magnitude of time t1, derives a total cooking time from a stored characteristic relating t1 to total cooking time. There then follows a second and final cooking stage during which the microwave power and radiant power are applied simultaneously and continuously, until the termination of cooking after the elapse of the derived total cooking time.

I claim:

1. A method of cooking food in a microwave oven comprising an oven cavity to receive the food, a magnetron for delivering microwave power to the oven cavity, means for admitting to the cavity a flow of air which cools the magnetron, and a radiant heating element for delivering radiant power to the oven cavity, wherein the temperature of the air cooling the magnetron is detected as the air enters the cavity to yield an air inlet temperature and the temperature is detected as the air leaves the cavity to yield an air outlet temperature, monitoring variations with time of the air inlet and air outlet temperatures, detecting a crossover temperature or a crossover time when said variations intersect, and utilising the magnitude of the crossover temperature or crossover time to control the duration of the remaining cooking time and the application of microwave power and radiant power during the remaining cooking time.

2. A method according to claim 1, wherein the complete cooking process comprises three stages, namely a first stage from commencement of cooking to said crossover point, a second stage from the crossover point to the time when the difference between the inlet and outlet temperatures reaches a selected value dependent on the crossover temperature or crossover time and a third stage from the termination of the second stage to the end of cooking, a microprocessor controlling the duration of the third stage and the energisation of the magnetron and the radiant heating element throughout cooking.

3. A method according to claim 2, wherein at the termination of the second stage the microprocessor derives the remaining cooking time by reference to a stored characteristic relating the time of the second stage to total cooking time.

4. A method according to claim 2, wherein microwave power and radiant power are delivered to the cavity continuously and simultaneously during the first and second stages.

5. A method according to claim 4, wherein the microwave power is produced continuously during the third stage and the radiant power is produced intermittently during the third stage so that pulses of radiant power are provided interspersed with periods of deenergisation of the radiant heating element, the proportion of the third stage during which the radiant power is produced being derived by reference to a stored characteristic relating said proportion to the total cooking time.

6. A method according to claim 1, wherein the complete cooking process comprises two stages, namely a first stage from commencement of cooking to said crossover point and a second and final stage from the crossover point to the end of cooking, at the end of the first stage a microprocessor deriving the remaining cooking time by reference to a stored characteristic relating total cooking time to the duration of the first stage.

7. A microwave oven comprising an oven cavity to receive food to be cooked, a magnetron for delivering microwave power to the oven cavity, means for admitting to the cavity a flow of air which cools the magnetron, a radiant heating element for delivering radiant power to the oven cavity, a timer for timing cooking, a first temperature sensor for sensing the temperature of the air flow as it enters the cavity, a second temperature sensor for sensing the temperature of the air flow as it leaves the cavity, and a microprocessor responsive to the timer and the first and second temperature sensors for controlling the magnetron and the radiant heating element, wherein the microprocessor is operative to: monitor variations with time of the air inlet and air outlet temperatures; detect a crossover temperature or crossover time when said variations intersect; and, in dependence on the magnitude of the crossover temperature or time, control the duration of the remaining cooking time and the application of microwave power and radiant power during the remaining cooking time.

8. A microwave oven according to claim 7, wherein the radiant heating element is a grill element positioned in the top of the cavity.

9. A microwave oven according to claim 7, wherein a turntable for supporting the food is positioned in the base of the cavity.

10. A microwave oven according to claim 7, wherein the oven is devoid of a turntable and includes a mode stirrer rotatably driven by a flow of air derived from a fan which also serves to generate a flow of air which cools the magnetron and is admitted to the cavity.

* * * * *